US011994353B2

(12) United States Patent
Bender

(10) Patent No.: US 11,994,353 B2
(45) Date of Patent: May 28, 2024

(54) FIRE CONTROL ASSEMBLY

(71) Applicant: In Ovation LLC, Vadnais Heights, MN (US)

(72) Inventor: Terrence Dwight Bender, Minneapolis, MN (US)

(73) Assignee: In Ovation LLC, Vadnais Heights, MN (US)

( * ) Notice: Subject to any disclaimer, the term of this patent is extended or adjusted under 35 U.S.C. 154(b) by 0 days.

(21) Appl. No.: 18/114,962

(22) Filed: Feb. 27, 2023

(65) Prior Publication Data

US 2023/0204314 A1 Jun. 29, 2023

Related U.S. Application Data

(62) Division of application No. 17/153,787, filed on Jan. 20, 2021, now Pat. No. 11,592,255.

(60) Provisional application No. 62/964,079, filed on Jan. 21, 2020, provisional application No. 62/963,526, filed on Jan. 20, 2020.

(51) Int. Cl.

| | |
|---|---|
| ***F41A 19/45*** | (2006.01) |
| ***F41A 17/74*** | (2006.01) |
| ***F41A 19/14*** | (2006.01) |
| ***F41A 19/15*** | (2006.01) |

(52) U.S. Cl.

CPC ..... *F41A 19/45* (2013.01); *F41A 17/74* (2013.01); *F41A 19/14* (2013.01); *F41A 19/15* (2013.01)

(58) Field of Classification Search

CPC ..... F41A 19/14; F41A 19/44; F41A 19/45; F41A 19/15

See application file for complete search history.

(56) References Cited

U.S. PATENT DOCUMENTS

| | | | | |
|---|---|---|---|---|
| 6,772,548 | B1 * | 8/2004 | Power | F41A 19/10 89/139 |
| 7,398,723 | B1 * | 7/2008 | Blakley | F41A 19/10 89/129.01 |
| 9,046,313 | B1 * | 6/2015 | Lutton | F41A 19/14 |
| 2016/0018176 | A1 * | 1/2016 | Fellows | F41A 19/14 42/69.03 |
| 2017/0299309 | A1 * | 10/2017 | Fellows | F41A 19/43 |
| 2018/0100712 | A1 * | 4/2018 | Tompkins | F41A 19/10 |
| 2023/0013610 | A1 * | 1/2023 | Werdnig | F41A 19/02 |

* cited by examiner

*Primary Examiner* — Gabriel J. Klein

(74) *Attorney, Agent, or Firm* — Laabs Intellectual Property

(57) ABSTRACT

In some embodiments, a fire control assembly comprises a frame, a hammer, a trigger and a disconnector. The frame is arranged to be supported along a trigger axis and a hammer axis. The hammer is rotatable about the hammer axis and the trigger is rotatable about the trigger axis. The frame comprises a hammer stop arranged to impede rotation of the hammer. The frame comprises a preloading mechanism arranged to contact a safety selector.

18 Claims, 6 Drawing Sheets

FIRE CONTROL ASSEMBLY

CROSS-REFERENCE TO RELATED APPLICATIONS

This application is a division and claims the benefit of U.S. patent application Ser. No. 17/153,787, filed Jan. 20, 2021, which claims the benefit of U.S. Patent Application No. 62/963,526, filed Jan. 20, 2020, and claims the benefit of U.S. Patent Application No. 62/964,079, filed Jan. 21, 2020, the entire content of each of which are hereby incorporated herein by reference.

BACKGROUND OF THE INVENTION

This invention relates to a fire control assembly for a firearm.

Firearms are often controlled by an assembly that includes a trigger and a hammer. Different fire control assemblies can be used in a given firearm, which can alter certain characteristics of the firearm. A user might select a particular fire control assembly to achieve a lighter trigger pull weight and/or a smoother trigger feel when compared to an OEM or mil-spec trigger. There can also be trade-offs with a non-mil-spec trigger, such as a loss of robustness.

In some known fire control assemblies, the hammer reaches an end of its travel path when it impacts another part of the fire control assembly, such as the disconnector. Under certain conditions, parts of a fire control assembly that impact one another can be damaged.

Additionally, due to manufacturing tolerances and variations in specific sizing and spacing of firearm housings, a fire control assembly can have fitment issues and can shift position slightly during operation.

There remains a need for novel fire control assemblies that provide benefits over prior designs.

All US patents and applications and all other published documents mentioned anywhere in this application are incorporated herein by reference in their entirety.

Without limiting the scope of the invention a brief summary of some of the claimed embodiments of the invention is set forth below. Additional details of the summarized embodiments of the invention and/or additional embodiments of the invention may be found in the Detailed Description of the Invention below.

A brief abstract of the technical disclosure in the specification is provided as well only for the purposes of complying with 37 C.F.R. 1.72. The abstract is not intended to be used for interpreting the scope of the claims.

BRIEF SUMMARY OF THE INVENTION

In some embodiments, a fire control assembly comprises a frame, a hammer, a trigger and a disconnector. The frame is arranged to be supported along a trigger axis and a hammer axis. The hammer is rotatable about the hammer axis and the trigger is rotatable about the trigger axis. The frame comprises a hammer stop arranged to impede rotation of the hammer.

In some embodiments, the hammer stop comprises a bumper. In some embodiments, the frame comprising a first material and the bumper comprises a second material different from the first material.

In some embodiments, the bumper comprises a stem engaged with the frame and an enlarged contacting surface.

In some embodiments, a hammer sleeve is attached to the frame and the hammer sleeve supports the hammer. In some embodiments, a trigger sleeve is attached to the frame and the trigger sleeve supports the trigger.

In some embodiments, the hammer comprises a first portion arranged to contact the disconnector and a second portion arranged to contact the hammer stop.

In some embodiments, a fire control assembly comprises a frame, a hammer, a trigger and a disconnector. The frame is arranged to be supported along a trigger axis and a hammer axis. The hammer is rotatable about the hammer axis and the trigger is rotatable about the trigger axis. The frame comprises a preloading mechanism arranged to contact a safety selector.

In some embodiments, the preloading mechanism is arranged to contact a shaft of the safety selector.

In some embodiments, the preloading mechanism comprises a biasing member and a contacting member, the contacting member moveable with respect to the frame via resilient deformation of the biasing member.

In some embodiments, a trigger spring is arranged to bias the trigger in a first rotational direction about the trigger axis and the preloading mechanism is arranged to bias the frame in a second rotational direction about the trigger axis.

In some embodiments, the preloading mechanism is centered in the frame between the first side and the second side.

In some embodiments, a distance between the trigger axis and the preloading mechanism is greater than a distance between the trigger axis and the hammer axis.

These and other embodiments which characterize the invention are pointed out with particularity in the claims annexed hereto and forming a part hereof. However, for a better understanding of the invention, its advantages and objectives obtained by its use, reference can be made to the drawings which form a further part hereof and the accompanying descriptive matter, in which there are illustrated and described various embodiments of the invention.

BRIEF DESCRIPTION OF THE DRAWINGS

A detailed description of the invention is hereafter described with specific reference being made to the drawings.

DETAILED DESCRIPTION OF THE INVENTION

Figure 1:
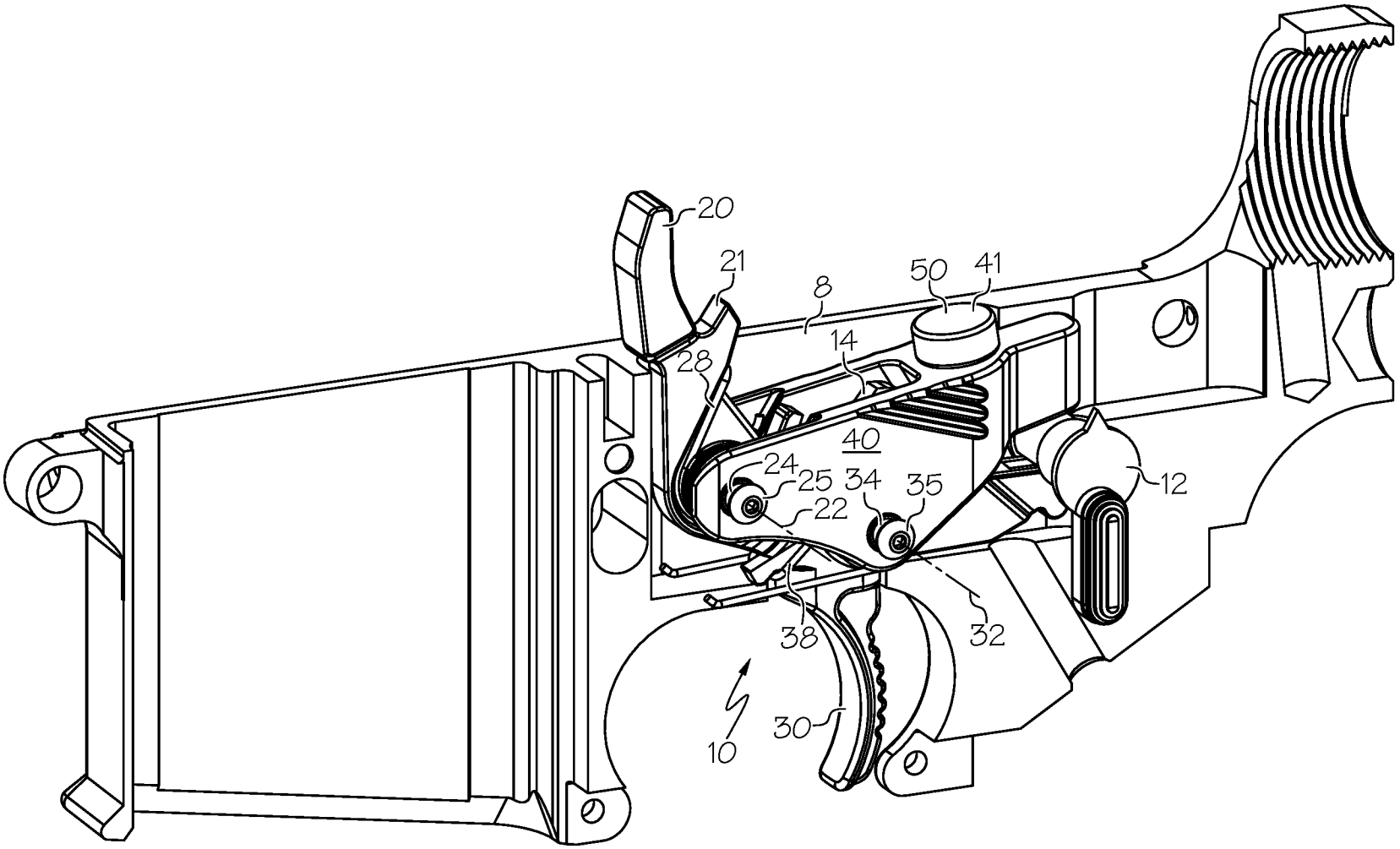
FIG. 1 shows an embodiment of a fire control assembly in a housing.
Figure 2:
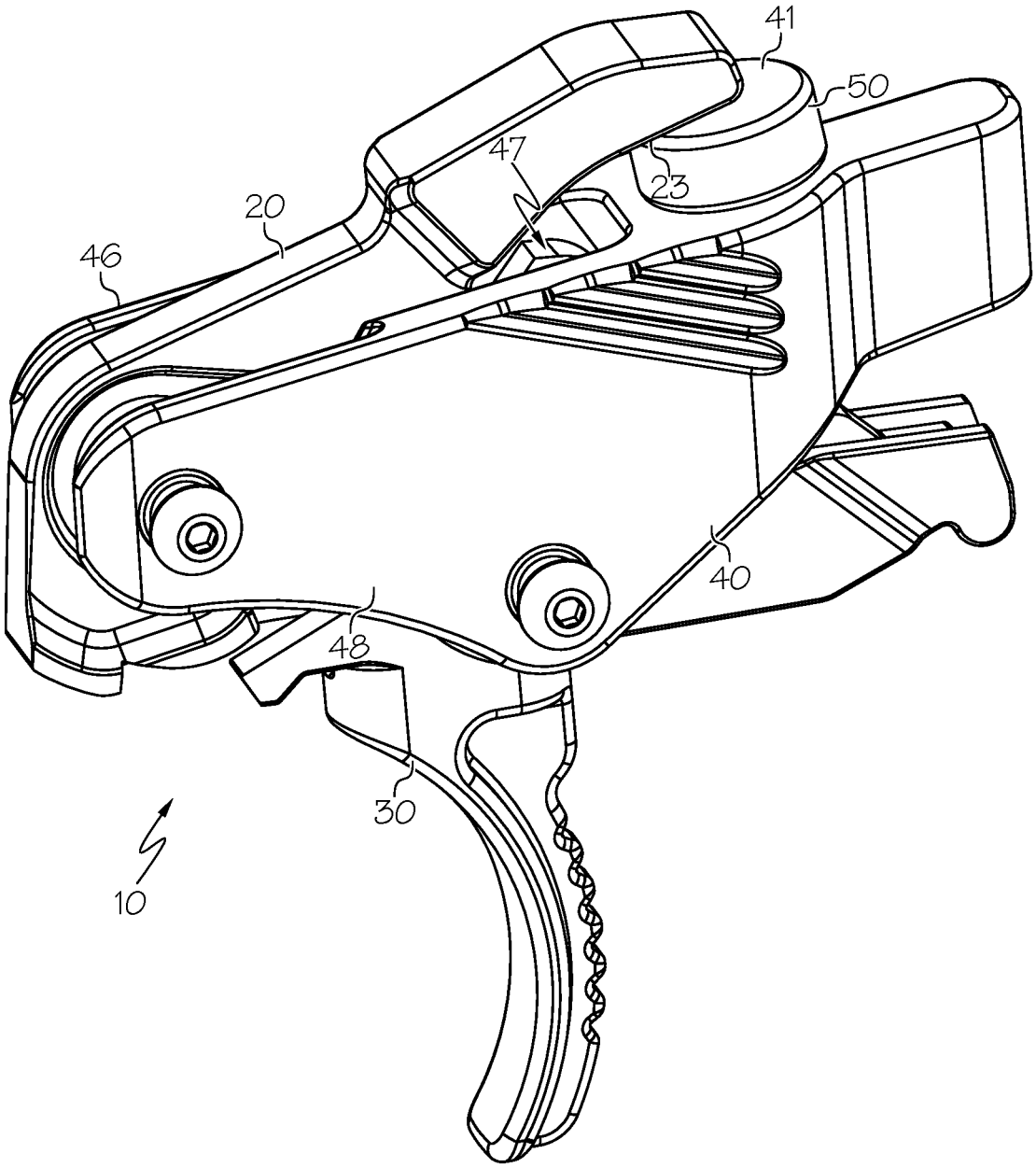
FIG. 2 shows an embodiment of a fire control assembly.
Figure 3:
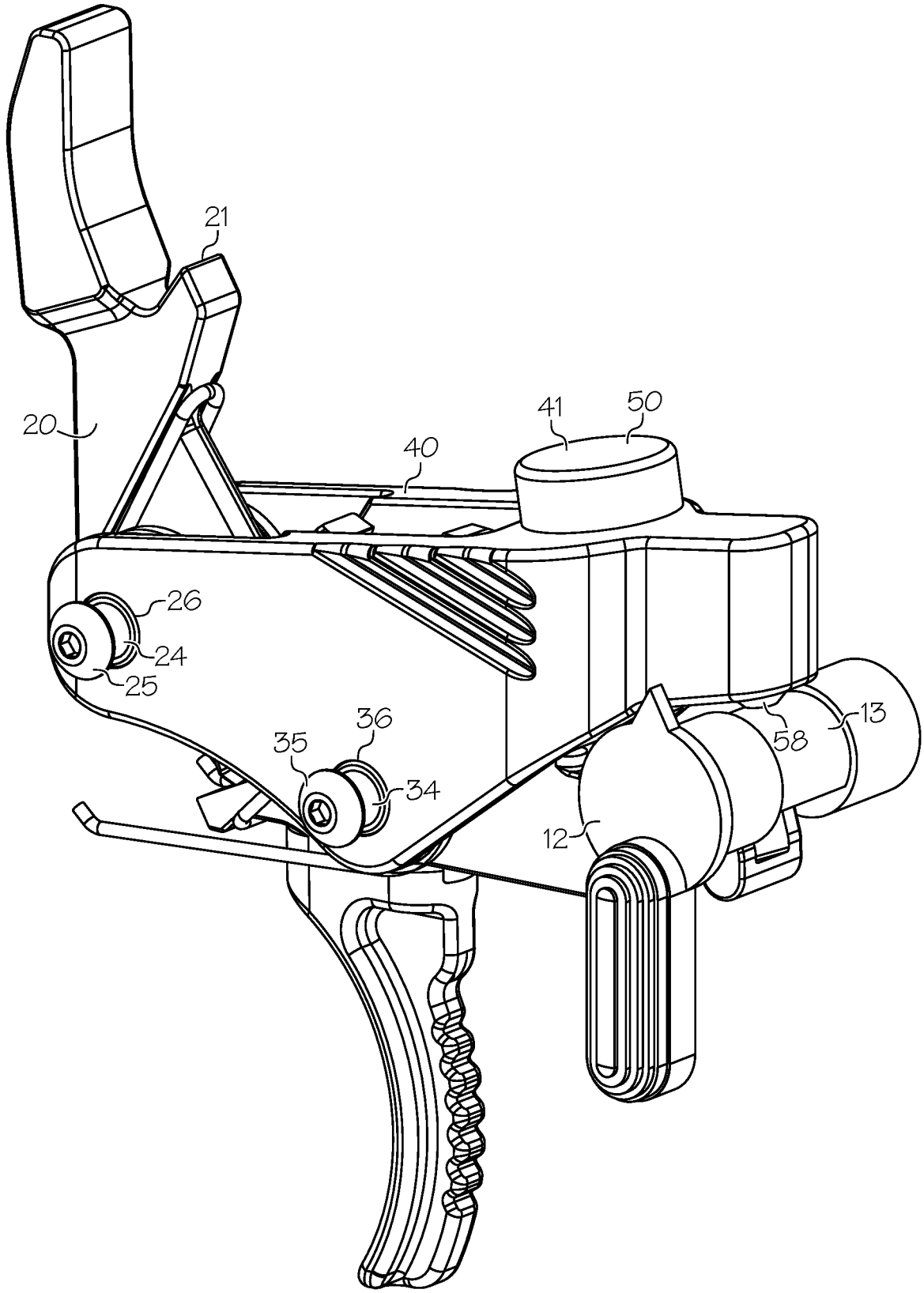
FIG. 3 shows another view of an embodiment of a fire control assembly.
Figure 4:
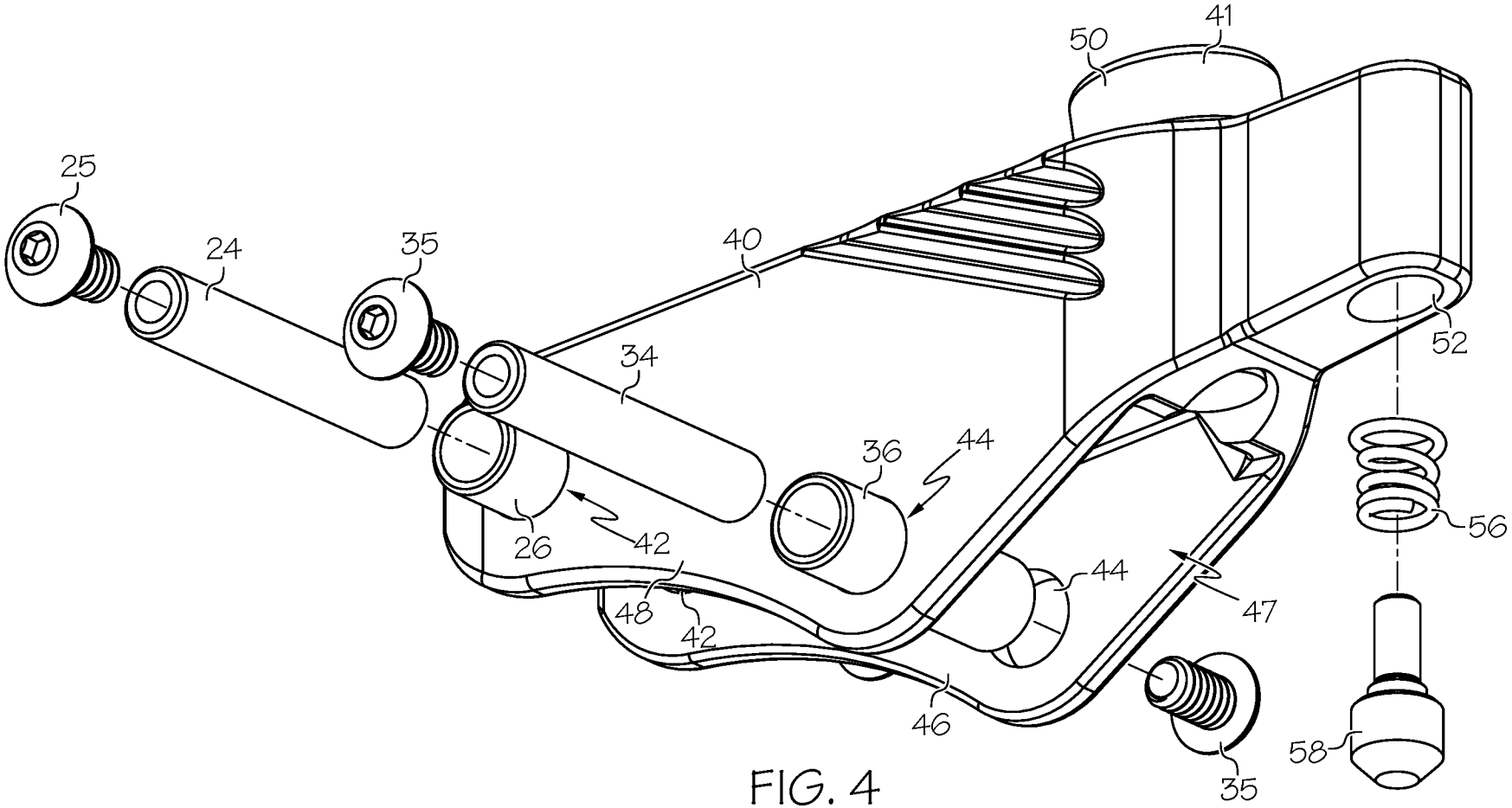
FIG. 4 shows an exploded view of a portion of an embodiment of a fire control assembly.

While this invention may be embodied in many different forms, there are described in detail herein specific embodiments of the invention. This description is an exemplification of the principles of the invention and is not intended to limit the invention to the particular embodiments illustrated.

For the purposes of this disclosure, like reference numerals in the figures shall refer to like features unless otherwise indicated.

FIG. 1 shows an embodiment of a fire control assembly 10 oriented in a housing 8. A fire control assembly 10 can be used in any suitable type of firearm. In some embodiments, a fire control assembly 10 is configured for use in an AR-style rifle, such as an AR15. In some embodiments, a housing 8 comprises an AR lower receiver. FIG. 1 shows the housing 8 partially cut away so parts of the fire control assembly 10 are more visible.

In some embodiments, the fire control assembly 10 comprises a hammer 20 arranged to pivot about a hammer axis 22 and a trigger 30 arranged to pivot about a trigger axis 32. In some embodiments, a trigger spring 38 is arranged to bias the trigger 30 in a first rotational direction (e.g. clockwise). In some embodiments, a hammer spring 28 is arranged to bias the hammer 20 in a second rotational direction (e.g. counter-clockwise). In some embodiments, the fire control assembly 10 comprises a disconnector 14 arranged to catch the hammer 20. In some embodiments, the fire control assembly 10 comprises a frame 40. In some embodiments, the frame 40 is arranged to support the hammer 20. In some embodiments, the frame 40 is arranged to support the trigger 30. In some embodiments, the fire control assembly 10 comprises a drop-in trigger assembly arranged to ease installation of the fire control assembly 10 in a housing 8.

Referring to FIGS. 1-4, in some embodiments, the frame 40 is constructed and arranged to be oriented within a cavity defined by the housing 8. In some embodiments, the frame 40 is constructed and arranged to be supported along the trigger axis 32. In some embodiments, the frame 40 is constructed and arranged to be supported along the hammer axis 22. In some embodiments, the frame 40 is supported by a hammer pin 24 and a trigger pin 34, which are supported by the housing 8.

In some embodiments, the frame 40 is engaged with or attached to a hammer sleeve 26, and the hammer sleeve 26 is arranged to support the hammer 20. In some embodiments, the frame 40 is engaged with or attached to a trigger sleeve 36, and the trigger sleeve 36 is arranged to support the trigger 30. In some embodiments, the hammer sleeve 26 is hollow and the trigger sleeve 36 is hollow. In some embodiments, the hammer pin 24 is arranged to be oriented in the hammer sleeve 26 and to engage the housing 8. In some embodiments, a trigger pin 34 is arranged to be oriented in the trigger sleeve 36 and to engage the housing 8. In some embodiments, fasteners 25 can be received by the hammer pin 24 and used to tighten the housing 8 to the fire control assembly 10. In some embodiments, fasteners 35 can similarly be attached to the trigger pin 34.

In some embodiments, the frame 40 comprises a unitary body comprising a first side 46 and a second side 48 defining a slot 47 therebetween. In some embodiments, the slot 47 provides clearance for the hammer 20, trigger 30, disconnector 14 and other parts of the fire control assembly 10. In some embodiments, the first side 46 and second side 48 each comprise a hammer aperture 42 and a trigger aperture 44. In some embodiments, the hammer apertures 42 are sized to receive the hammer sleeve 26 and the trigger apertures 44 are sized to receive the trigger sleeve 36.

In some embodiments, the frame 40 comprises a hammer stop 41. In some embodiments, the hammer 20 comprises a surface 23 arranged to contact the hammer stop 41. Desirably, the hammer stop 41 is arranged to impede movement of the hammer 30. In some embodiments, as the hammer 20 travels, a catch 21 of the hammer 20 is able to engage the disconnector 14, then the hammer stop 41 operates to stop rotation of the hammer 20 before another portion of the hammer 20 contacts the disconnector 14. In some embodiments, the hammer stop 41 comprises a bumper 50.

In some embodiments, a fire control assembly 10 comprises a preloading mechanism 54 arranged to stabilize the fire control assembly 10 in the housing 8. In some embodiments, the frame 40 comprises a preloading mechanism 54. In some embodiments, the preloading mechanism 54 is arranged to apply forces between the frame 40 and another portion of the firearm. In some embodiments, the preloading mechanism 54 is arranged to apply forces between the frame 40 and a safety selector 12 that is supported by the housing 8. In some embodiments, a preloading mechanism 54 comprises a biasing member 56 such as a spring and a contacting member 58 arranged to contact the safety selector 12. In some embodiments, the contacting member 58 contacts a shaft 13 of the safety selector 12. In some embodiments, the biasing member 56 and contacting member 58 are received in a cavity 52 formed in the frame 40. In some embodiments, the cavity 52 is oriented along a midline of the frame 40. In some embodiments, the preloading mechanism 54 is oriented on a midline of the frame 40. In some embodiments, the preloading mechanism 54 is centered between the first side 46 and second side 48 of the frame 40.

Figure 5:
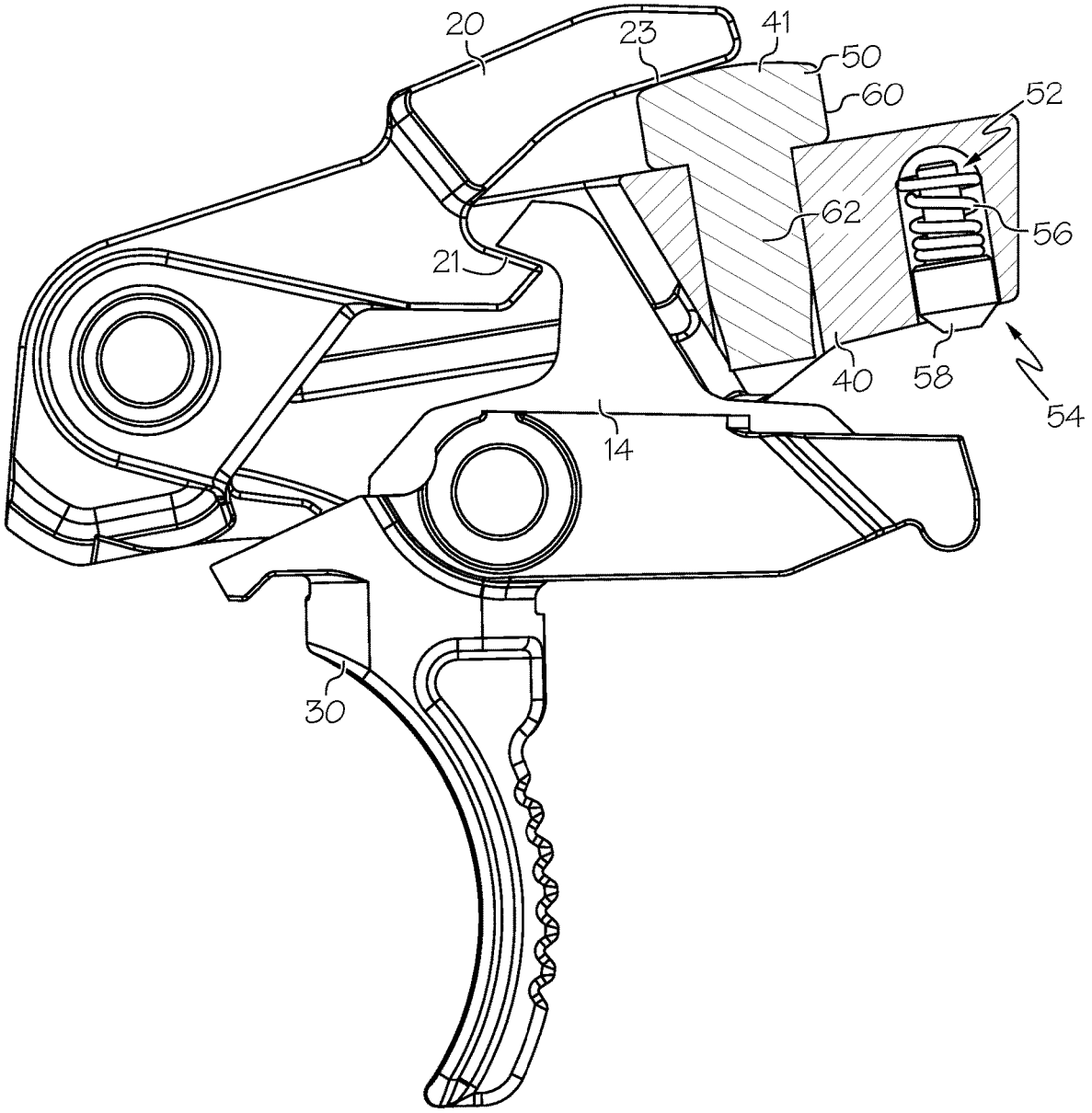
FIG. 5 shows a partial sectional view of an embodiment of a fire control assembly.
Figure 6:
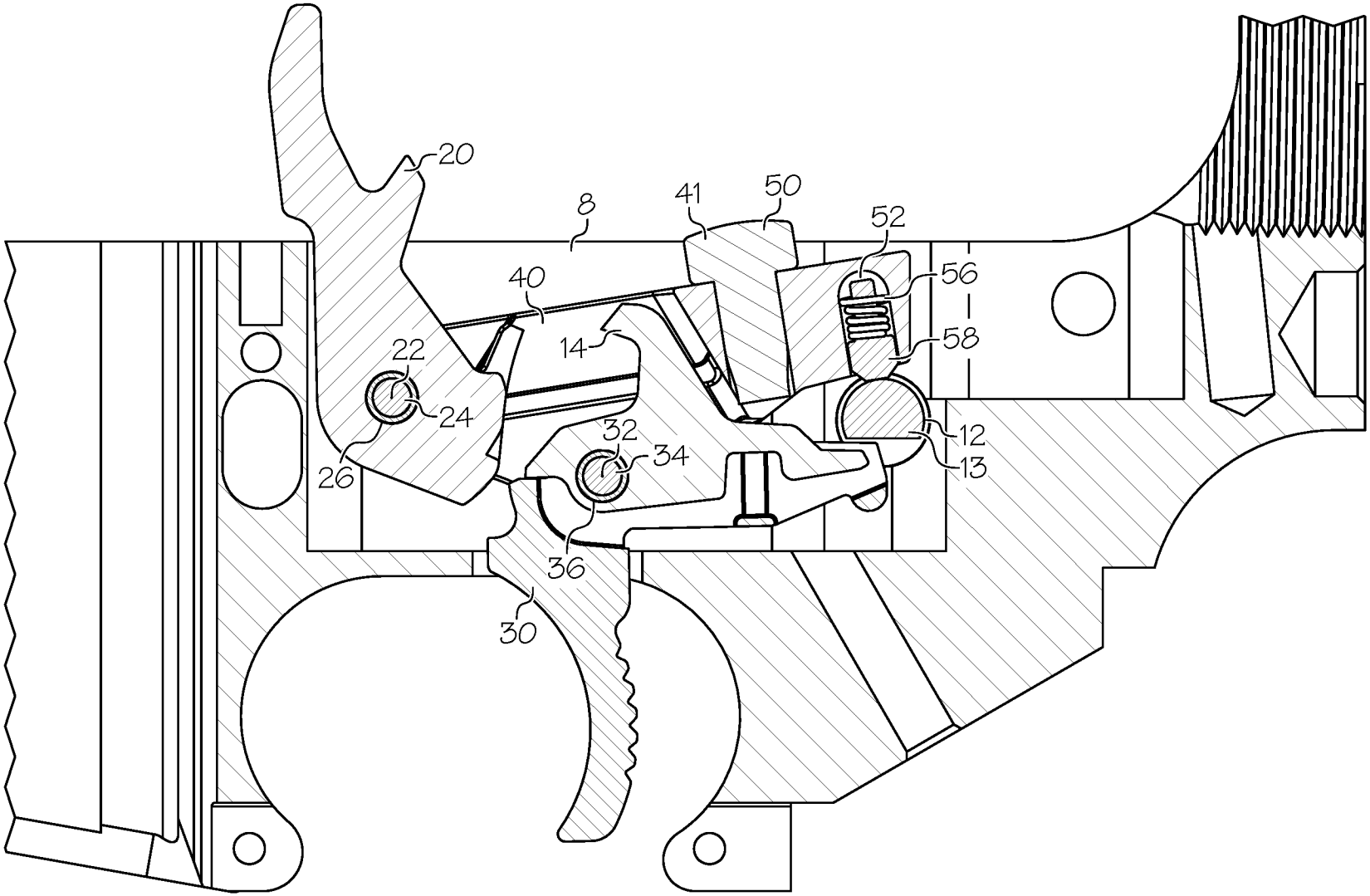
FIG. 6 shows a partial sectional view of an embodiment of a fire control assembly in a housing.

FIGS. 5 and 6 show partial cross-sectional views of an embodiment of a fire control assembly 10. In some embodiments, a fire control assembly 10 comprises a disconnector 14. In some embodiments, the disconnector 14 is supported by the trigger sleeve 36.

In some embodiments, a bumper 50 can be made from any suitable material and desirably comprises a rubber, elastomer, urethane or any other material arranged to cushion the hammer impact. In some embodiments, the frame 40 comprises a first material, such as metal, and the bumper 50 comprises a second material different from the first material.

In some embodiments, a bumper 50 comprises a stem 62 that is received by the frame 40. In some embodiments, the frame 40 engages the bumper 50 via friction, although any suitable engagement mechanism can be used. In some embodiments, the bumper 50 comprises a flange 60 having an enlarged face portion arranged to contact the hammer 20. In some embodiments, a distance across the flange 60 is greater than a distance across the stem 62. In some embodiments, a diameter of the flange 60 is greater than a diameter of the stem 62.

In some embodiments, the hammer 20 is moveable between first and second stop positions. FIG. 6 shows the hammer 20 in a first stop position, such as a fire position where the firearm discharges a round. After discharging a round, the firearm action will typically force the hammer 20 backwards, for example causing the hammer 20 to rotate clockwise in FIG. 6. FIG. 5 shows the hammer 20 in a second stop position, wherein a surface 23 of the hammer 20 contacts the bumper 50. Desirably, the bumper 50 is arranged to stop travel of the hammer 20 before the hammer 20 contacts the top of the disconnector 14, preventing the disconnector 14 from functioning as a travel stop.

In some embodiments, a catch 21 portion of the hammer 20 contacts the disconnector 14, and the hammer stop 41 prevents another portion of the hammer 20 from contacting the disconnector 14.

FIG. 6 shows an embodiment of a safety selector 12 supported by the housing 8. The fire control assembly 10, including the frame 40, is supported by the hammer pin 24 and trigger pin 34, which are supported by the housing 8. The preloading mechanism 54 also biases the frame 40 against the safety selector 12.

In some embodiments, the preloading mechanism 54 applies a force between the safety selector 12 and the frame 40, which results in a stabilizing torque being applied between the frame 40 and the supporting hammer and trigger pins 24, 34. In some embodiments, the preloading mechanism 54 applies a rotational force to the frame 40 about the trigger pin 34 in the same direction as the trigger operation. For example, in FIG. 6, the preloading mechanism 54 is arranged to apply a force to the frame 40 that biases the frame 40 in a counter-clockwise direction about the trigger pin 34, and the trigger 30 will move in the counter-clockwise direction when operated. Thus, the preloading mechanism 54 is arranged to stabilize the fire control assembly 10 to take up any slack caused by gaps due to manufacturing tolerances, etc.

In some embodiments, a trigger spring 38 is arranged to bias the trigger 30 in a first rotational direction (e.g. clockwise) about the trigger axis 32 and the preloading mechanism 54 is arranged to bias the frame 40 in a second rotational direction (e.g. counter-clockwise) about the trigger axis 32.

In some embodiments, the biasing member 56 comprises a coil spring. In some embodiments, the biasing member 56 comprises a compression spring. In some embodiments, the biasing member 56 is oriented in a cavity 52 in the frame 40. In some embodiments, a portion of the contacting member 58 is oriented in the cavity 52. In some embodiments, a portion of the contacting member 58 is oriented outside of the cavity 52. In some embodiments, the contacting member 58 comprises a first portion engaged with the biasing member 56 and a second portion arranged to contact the safety selector 12. In some embodiments, the contacting member 58 is moveable with respect to the frame 40. In some embodiments, the contacting member 58 moves along the length of the cavity 52.

In some embodiments, the trigger axis 32 is located between the hammer axis 22 and the preloading mechanism 54. In some embodiments, a distance between the trigger axis 32 and the preloading mechanism 54 is greater than a distance between the trigger axis 32 and the hammer axis 22.

The above disclosure is intended to be illustrative and not exhaustive. This description will suggest many variations and alternatives to one of ordinary skill in this field of art. All these alternatives and variations are intended to be included within the scope of the claims where the term "comprising" means "including, but not limited to." Those familiar with the art may recognize other equivalents to the specific embodiments described herein which equivalents are also intended to be encompassed by the claims.

Further, the particular features presented in the dependent claims can be combined with each other in other manners within the scope of the invention such that the invention should be recognized as also specifically directed to other embodiments having any other possible combination of the features of the dependent claims. For instance, for purposes of claim publication, any dependent claim which follows should be taken as alternatively written in a multiple dependent form from all prior claims which possess all antecedents referenced in such dependent claim if such multiple dependent format is an accepted format within the jurisdiction (e.g. each claim depending directly from claim 1 should be alternatively taken as depending from all previous claims). In jurisdictions where multiple dependent claim formats are restricted, the following dependent claims should each be also taken as alternatively written in each singly dependent claim format which creates a dependency from a prior antecedent-possessing claim other than the specific claim listed in such dependent claim below.

This completes the description of the preferred and alternate embodiments of the invention. Those skilled in the art may recognize other equivalents to the specific embodiment described herein which equivalents are intended to be encompassed by the claims attached hereto.

The invention claimed is:

1. A fire control assembly arranged for orientation in a housing, the housing supporting a safety selector, the fire control assembly comprising:

a frame arranged to be supported by the housing;

a hammer rotatable about the hammer axis;

a trigger rotatable about the trigger axis;

a disconnector; and a preloading mechanism arranged to bias the frame away from the safety selector, wherein the preloading mechanism contacts the safety selector and the frame does not contact the safety selector.

2. The fire control assembly of claim 1, the frame comprising a first side, a second side and a cavity, the cavity centered between the first side and the second side, at least a portion of the preloading mechanism oriented in the cavity.

3. The fire control assembly of claim 2, the preloading mechanism comprising a spring and a contacting member, the spring contacting the frame, the contacting member contacting the safety selector.

4. The fire control assembly of claim 3, the spring oriented in the cavity.

5. A fire control assembly arranged for orientation in a housing, the housing supporting a safety selector, the fire control assembly comprising:

a frame comprising a body and a preloading mechanism, the body arranged to be supported by the housing along a trigger axis and a hammer axis;

a hammer rotatable about the hammer axis;

a trigger rotatable about the trigger axis; and a disconnector;

wherein the preloading mechanism contacts the safety selector and the body does not contact the safety selector.

6. The fire control assembly of claim 5, the preloading mechanism arranged to contact a shaft of the safety selector.

7. The fire control assembly of claim 5, the preloading mechanism comprising a biasing member and a contacting member, the contacting member moveable with respect to the body via deformation of the biasing member.

8. The fire control assembly of claim 7, the biasing member comprising a coil spring.

9. The fire control assembly of claim 8, the contacting member comprising a pin oriented in the coil spring.

10. The fire control assembly of claim 7, the body comprising a cavity, the biasing member oriented in the cavity.

11. The fire control assembly of claim 10, wherein a portion of the contacting member is oriented outside of the cavity.

12. The fire control assembly of claim 5, comprising a trigger spring arranged to bias the trigger in a first rotational direction about the trigger axis, the preloading mechanism arranged to bias the body in a second rotational direction about the trigger axis.

13. The fire control assembly of claim 5, the body comprising a first side and a second side, the preloading mechanism centered between the first side and the second side.

14. The fire control assembly of claim 5, wherein a distance between the trigger axis and the preloading mechanism is greater than a distance between the trigger axis and the hammer axis.

15. The fire control assembly of claim 5, comprising a trigger sleeve attached to the body, the trigger sleeve supporting the trigger.

16. The fire control assembly of claim 15, comprising a trigger pin oriented inside the trigger sleeve, the trigger pin supported by the housing.

17. The fire control assembly of claim 5, the frame comprising a hammer stop arranged to impede rotation of the hammer.

18. The fire control assembly of claim 17, the body comprising a first side and a second side, the hammer stop centered between the first side and the second side.

* * * * *